United States Patent [19]

Spinosa et al.

[11] Patent Number: 4,750,447

[45] Date of Patent: Jun. 14, 1988

[54] INFLATABLE LIFE RAFT

[75] Inventors: Dominic J. Spinosa, Wantagh; Frank Knoll, Huntington Station, both of N.Y.

[73] Assignee: East/West Industries, Inc., Hauppauge, N.Y.

[21] Appl. No.: 681,095

[22] Filed: Dec. 13, 1984

Related U.S. Application Data

[63] Continuation of Ser. No. 551,405, Nov. 14, 1983, abandoned.

[51] Int. Cl.[4] ..... B63B 7/08

[52] U.S. Cl. ..... 114/345; 441/40; 441/41

[58] Field of Search ..... 114/183 R, 345, 346, 114/348, 349, 354; 441/35, 38, 40, 41, 66, 87, 129–131; 5/441, 449, 450, 455, 458, 457

[56] References Cited

U.S. PATENT DOCUMENTS

| | | | |
|---|---|---|---|
| 574,503 | 1/1897 | Van Meter | 5/455 |
| 2,562,080 | 7/1951 | Barnes | 441/131 |
| 2,816,299 | 12/1957 | Holladay | 5/457 |
| 3,899,797 | 8/1975 | Gunst | 5/441 |
| 4,001,905 | 1/1977 | Givens | 441/38 |
| 4,050,396 | 9/1977 | Ridgeway | 114/183 R |
| 4,090,270 | 5/1978 | Horan | 114/345 |
| 4,131,399 | 12/1978 | Calvet | 138/118 |
| 4,187,570 | 2/1980 | De Simone | 441/38 |
| 4,268,930 | 5/1981 | Gillespie | 114/345 |
| 4,334,278 | 8/1982 | Horan | 114/345 |

FOREIGN PATENT DOCUMENTS

| | | | |
|---|---|---|---|
| 254736 | 6/1927 | United Kingdom | 114/345 |
| 698149 | 10/1953 | United Kingdom | 441/40 |
| 789334 | 1/1958 | United Kingdom | 441/40 |

*Primary Examiner*—Joseph F. Peters, Jr.
*Assistant Examiner*—Stephen P. Avila
*Attorney, Agent, or Firm*—Leonard W. Suroff

[57] ABSTRACT

An inflatable life raft which forms a passenger receptacle, has a removable canopy for covering the passenger receptacle and is formed from a flexible walled housing which includes inner and outer walls, with a plurality of chambers being formed between the walls. A bleeder mechanism, in the form of a plurality of cords disposed in the chambers keep substantially all of the areas of the chambers in communication with each other so that inflation and more especially deflation, can be readily accomplished without forming air pockets caused by the inner and outer chamber walls sticking together precluding the free flow of air.

5 Claims, 3 Drawing Sheets

FIG. 1
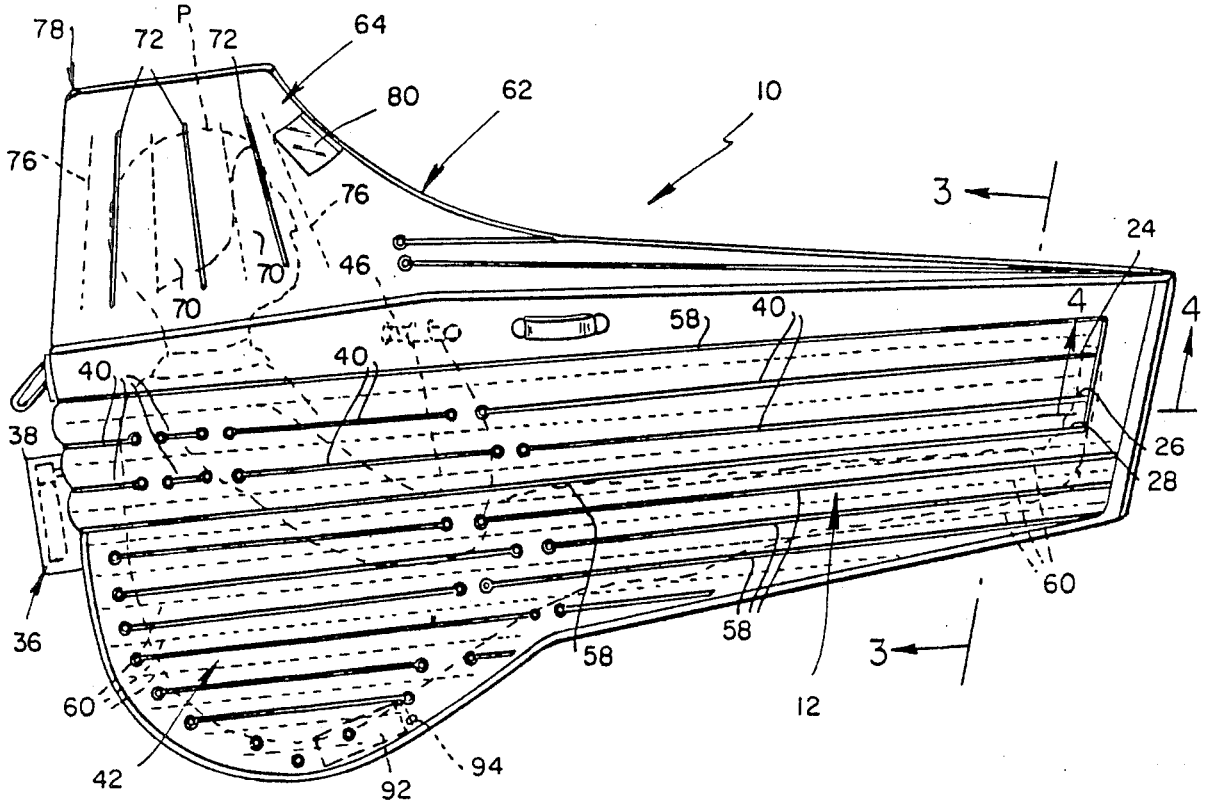
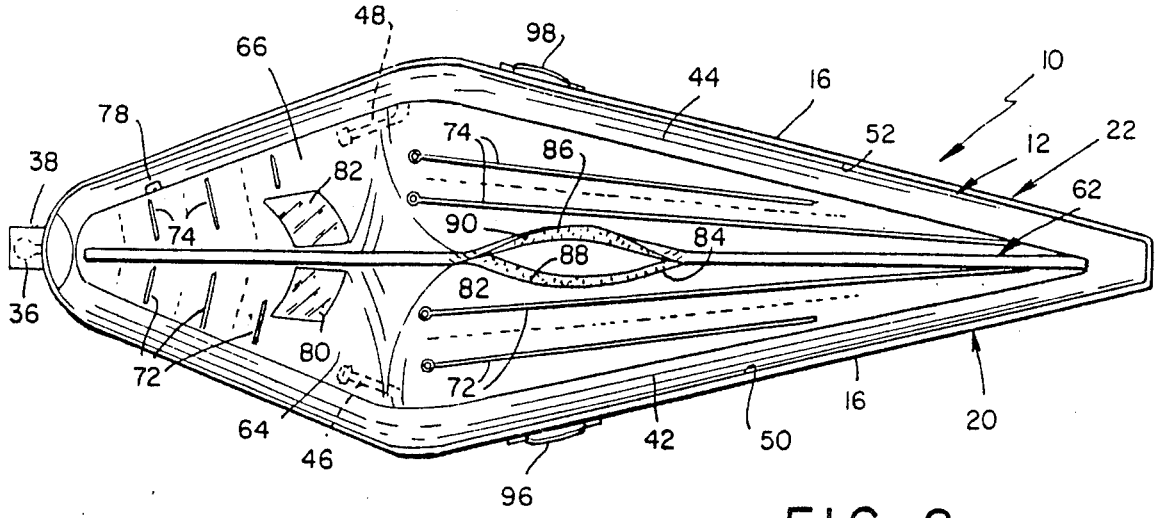
FIG. 2

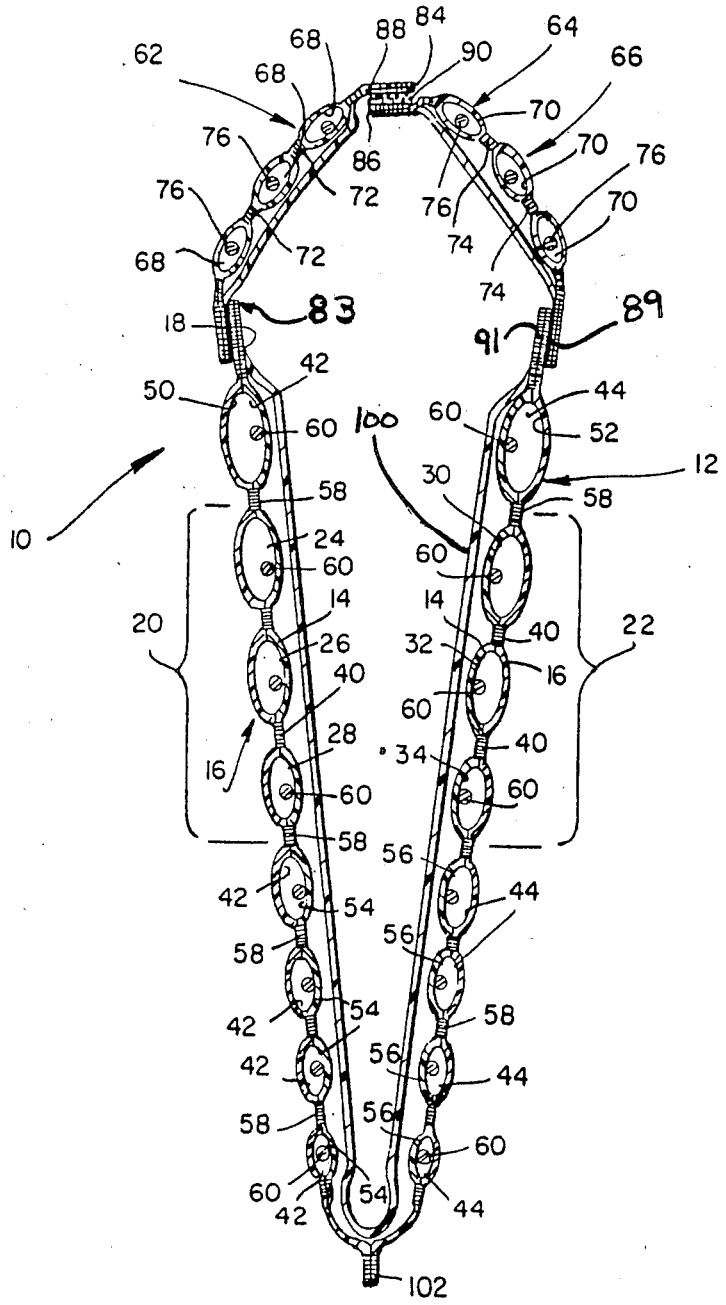
FIG. 3
FIG. 6
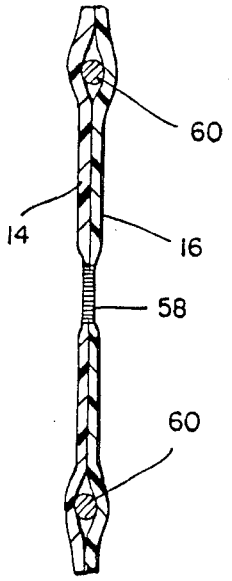
FIG. 4
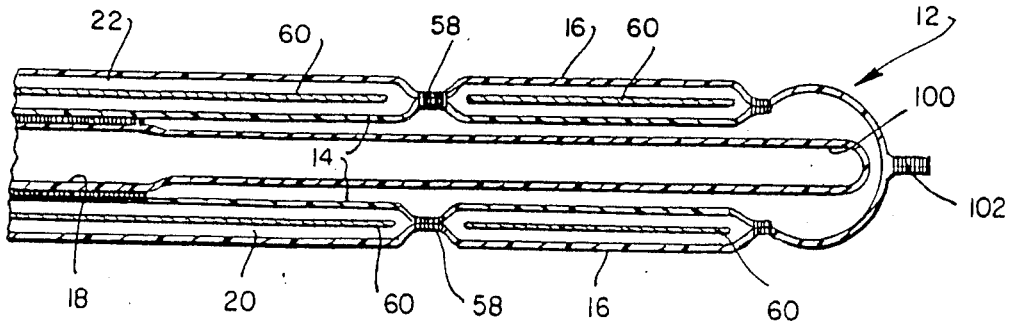

INFLATABLE LIFE RAFT

This application is a continuation, of application Ser. No. 551,405, filed Nov. 14, 1983 now abandoned.

BACKGROUND OF THE INVENTION

1. Field of the Invention

The present invention relates to very tightly compactable and rapidly inflatable apparatuses, and more particularly, to an inflatable life raft which includes bleeder means in the inflatable chambers thereof to facilitate evacuation of air therefrom when the life raft is folded and stored.

2. Description of the Prior Art

Inflatable rafts which can be compacted into extremely small packages have found considerable acceptance for use as life saving devices during emergencies. Theses rafts are designed so that they include a passenger receptacle and are formed with a plurality of inflatable chambers provided in the walls of the raft which are inflated for use. Such life rafts have been inflatable either through oral exhalation of the passenger into a mouthpiece valve or through the use of $CO_2$ cartridges which expell its contents in the inflatable chambers, upon demand.

The usability and practicality of employing an inflatable life raft depends upon having such apparatus readily accessible when needed. Accessibility basically can be equated to how compactly such an apparatus can be stored when not used. The more compact such an apparatus is when stored, the more accessible a location it can be stored in. For instance, it might be carried in a pocket of the potential user. As a result of such accessibility, it is more likely that an inflatable life raft will be available when needed. If the life raft is bulky and therefore is difficult to store conveniently, it is not as likely that it can be effectively stored and employed.

On inflatable life raft taught by the prior art is shown in U.S. Pat. No. 4,090,270 issued to Horian on May 23, 1981. This life raft has a rather effective configuration but suffers from the problem of difficulty in deflation and compact storage. Specifically, once the raft has been used, or even just after it is manufactured, it must be folded into a very compact form for storage. As one folds the life raft into a storage position and tries to simultaneously evacuate the air therefrom, the folds in the material create air pockets which a trap air therein and it therefore becomes extremely difficult to evacuate all the trapped air. This trapped air, even after many attempts at forcing it out of the air pockets remains therein and contributes to the bulk of the life raft when stored.

The present invention overcomes this problem associated with the prior art by providing an inflatable life raft which includes a plurality of inflatable chambers that each have disposed therein bleeder means which keep substantially all the areas of the chambers in communication with each other so that as the apparatus is deflated the air can be successfully forced out of the chambers, even when they are folded, as a result of the bleeder means disposed therein. Specifically, even when the material is folded back upon itself, no air can be trapped by such a fold since the bleeder means is also folded and creates an air path through the fold.

In addition, the present invention provides a significant advantage over the prior art by the incorporation of a removable canopy which fits over the passenger receiving receptable of the life raft to protect the passenger from the elements when necessary.

OBJECTS OF THE INVENTION

An object of the present invention is to provide an inflatable apparatus which can be folded for compact storage as a result of the incorporation of structure which permits the evacuation of substantially all the air disposed therein.

Another object of the present invention is to provide an inflatable life raft which can be stored into an extremely compact package.

Still another object of the present invention is to provide an inflatable life raft which can be inflated either by oral means or by discharge of a compressed gas bottle or a combination thereof.

A further object of the present invention is to provide an inflatable life raft which includes a canopy that shields the user of the life raft from the elements.

A still further object of the present invention is to provide an inflatable life raft which is ideally suited for carrying on the person of a potential user.

An additional object of the present invention is to provide an inflatable life raft which incorporates means that permit the bailing out of the passenger compartment thereof.

A still further additional object of the present invention is to provide an inflatable life raft which is simple in design, inexpensive to manufacture, efficient in operation, rugged in construction, and durable.

Still yet another object of the present invention is to provide a protective canopy that may be removed as desired.

Other objects and advantages of the present invention will become apparent as the disclosure proceeds.

SUMMARY OF THE INVENTION

An inflatable life raft constructed in accordance with the principles of the present invention includes a flexible housing which is formed of inner and outer walls. The inner and outer walls form therebetween a plurality of inflatable chambers, some of the inflatable chambers being in communication with others and some aggregations of chambers being separated from the other chambers. Some of the aggregations of chambers are coupled to bottled compressed gas discharge means for the inflation thereof, the balance of the chambers being connected to an oral inflation valve for inflation by the user.

The flexible walled housing forms a passenger receptacle which is covered by a canopy that is removable and may be inflatable. At least one window is disposed in the canopy to facilitate observation of the raft's surroundings by the passenger.

When initially boarded, such boarding by the passenger is aided by a plurality of handles disposed about the mouth of the passenger compartment. Recognizing the possibility of the filling of the passenger compartment with unwanted liquid, a pump unit is provided which will automatically bail out the passenger compartment upon activation.

To insure that the life raft is readily accessible, it can be folded into an extremely compact package due to bleeders which permit the evacuation of substantially all the air from the inflatable chambers of the raft. This is accomplished by the bleeders, in the form of a plurality of cords, being disposed in each of the inflatable chambers. These cords permit communication between substantially all the areas of the chambers with each other so that folding of the flexible walls of the raft does not preclude passage of air through the chambers. The cords are preferably fixedly secured to the walls of the housing at preselected locations to preclude their migration in the chambers. The apparatus is preferably constructed from coated nylon for maximum durability and lightness in weight. The coating on the nylon may be urethane.

BRIEF DESCRIPTION OF THE DRAWING

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a pictorial representation of a life raft incorporating the principles of the present invention therein;

FIG. 2 is a top plan view of the like raft of FIG. 1;

FIG. 3 is a cross sectional view of the life raft of FIG. 1 taken substantially along the lines 3—3 thereof;

FIG. 4 is a cross sectional view of the life raft of FIG. 1 taken substantially along the lines 4—4 thereof;

FIG. 6 is a cross sectional view of the inflatable chambers of the present invention in a deflated position;

DETAILED DESCRIPTION OF THE DRAWINGS

Figure 5:
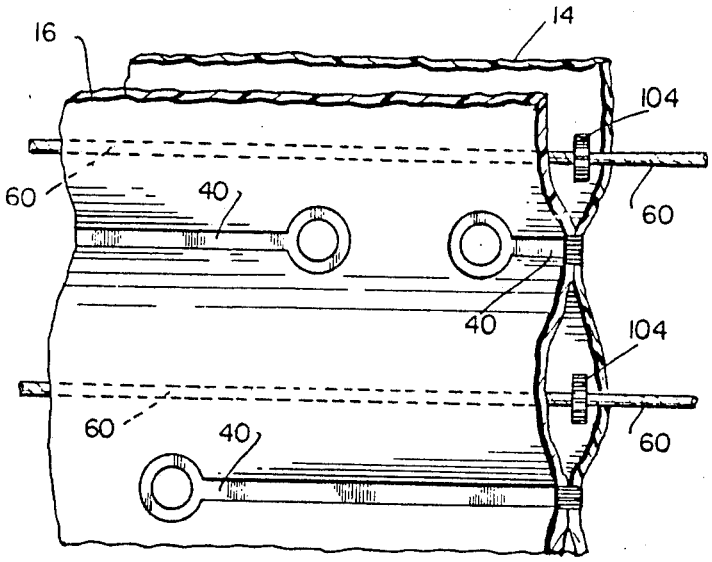
FIG. 5 is an enlarged fragmentary view of the inflatable chambers of the present invention.

Referring now to the drawings, and more particularly to FIGS. 1, 2 and 3 thereof, which illustrates a life raft 10 constructed in accordance with the principles of the present invention. The life raft 10 is constructed and formed from a flexible walled housing 12. The housing 12 includes inner walls 14, as illustrated in FIG. 3, and outer walls 16. The inner walls 14 and outer walls 16 are shaped to form a passenger receptacle 18 into which a passenger P can be acommodated. The inner and outer walls 14 and 16 form therebetween a pair of $CO_2$ inflatable chambers 20 and 22, as further illustrated in FIG. 3. The $CO_2$ inflatable chambers 20 and 22 are in communication with each other and are divided, respectively, into a plurality of subchambers 24, 26, 28, and 30, 32, and 34. The $CO_2$ inflatable chambers 20 and 22 are in communication with a compressed gas filling assembly 36 which is illustrated covered by a cover 38, both as further illustrated in conjunction with FIG. 7. The chambers 20 and 22 are disposed adjacent to the top of the passenger receptacle 18 and, when inflated, permit the boarding of the raft 10 by the passenger P. The chambers 20 and 22 are divided, respectively, into the subchambers 24 through 28 and 30 through 34 by a plurality of thermal welds 40.

The balance of the life raft 10 comprises a pair of orally inflatable chambers 42 and 44 which are in communication with each other. The orally inflatable chambers 42 and 44 are inflatable by oral inflation valve 46, the operation of which will be further disclosed in conjunction with the discussion of FIG. 9. Oral inflation valve 48 is used to orally inflate the life raft 10 if the $CO_2$ inflator 36 does not fully work. The valve 48 can also be used to top off the $CO_2$ if additional pressure is required. The orally inflatable chambers 44 and 46 are essentially U-shaped and each, respectively, includes a subchamber 50 and 52 adjacent to the uppermost edge of the housing 12 forming a mouth therefor, and, respectively, a plurality of subchambers 54 and 56 disposed adjacent to the bottom of the raft 10.

The subchambers 54 are all in communication with each other as are the subchambers 56, the subchambers 54 and 56 being formed by a plurality of thermal welds 58. The thermal welds 58 between the $CO_2$ inflatable chambers 20 and 22 and the orally inflatable chambers 42 and 44 isolate these chambers from each other so that the orally inflatable chambers 42 and 44 can only be inflated orally and the $CO_2$ inflatable chambers 20 and 22 can only be inflated through discharge of the $CO_2$ in the compressed gas filling assembly 36 or top off orally by valve 38. Each of the subchambers 24 through 34 and 50 through 56 has disposed therein a suitable length of cord 60, the cord 60 serving as bleeder means for making sure that substantially all areas of each of the chambers 20 and 22 and 46 and 48 stay in communication with each other to facilitate inflation and deflation.

Removably, secured to the housing 12 at the mouth of the passenger receptacle 18 thereof is an inflatable canopy 62. The inflatable canopy 62 includes two halves 64 and 66 having inner and outer walls which form therebetween respectively, a plurality of chambers 68 and 70. The chambers 68 and 70 form a plurality of subchambers divided by a plurality of thermal welds 72 and 74. Disposed within the subchambers formed by the thermal welds 72 and 74 are a plurality of cords 76 which perform the same function as the cords 60. The inflatable canopy 62 is contoured to provide a head accommodating section 78 which has disposed therein a pair of windows 80 and 82 to permit visualization of the environment by the passenger P.

Ingress and egress to the passenger receptacle 18 is provided through an opening creating by the separation of the halves 64 and 66 of the canopy 62 as is illustrated in FIGS. 2 and 3. The edges, respectively, 84 and 86 of the halves 64 and 66 of the canopy 62 and have disposed adjacent thereto respectively, hook and pile type fasteners, 88 and 90 which are selectively mated to seal the opening between the halves 64 and 66. Similar hook and pile type fasteners 89 and 91 are provided along the edge 93 of passenger receptacle 18 and the cooperating edge 95 of the canopy 62. Instead of hook and pile type fasteners, also known under the trade name Velcro, a zipper or the like which is preferably accessible from the inside of the life raft 10 may be provided. Similarly, a removable canopy which is not inflatable and which serves as a splash shield can be provided in lieu of canopy 62. The canopy 62 may incorporate its own inflation means such as an oral inflation valve, not illustrated, or the chambers thereof can be in communication with the chambers of the housing 12 to permit inflation.

Disposed adjacent to the bottom of the passenger receptable 18 is a pump unit 92 having a discharge 94. The pump unit 94 can be of the manual type or can be powered by a small storage battery and is provided to bail out any water which may enter the receptacle 18 during boarding by the passenger P. To aid in the boarding of the life raft 10 handles 96 and 98, fixedly secured to the outer walls 16 of the housing 12 are provided. Of course, more handles or handles located at different positions may also be provided. The housing 12 and the inner walls 14 and 16 thereo are preferably formed of waterproof and airtight material such as coated nylon or the like. Of course, the housing 12 may be fabricated of other suitable materials and methods other than thermal welding for joining together of the walls and the various components of the housing 12 can be employed.

With reference to FIG. 3, the manner in which the cords 60 and 76 are disposed within the chambers can be observed. The cords 60 and 76 are preferably of a woven material, such as nylon, which, even when folded, permits free passage of air therethrough. The cords serve as a bleeder mechanism to insure that substantially all of the areas of each of the chambers and subchambers thereof are in communication with the balance of the connected chambers and/or subchambers to insure rapid evacuation of air from the chambers and subchambers thereof when the life raft 10 is folded for storage. Additionally, if the life raft 10 is stored for long periods of time, the presence of the cords 60 and 76 will preclude malfunctioning of the life raft 10 caused by the sticking together of the inner walls 14 and outer walls 16 since such sticking cannot preclude the passage of air to substantially all the spaces defined by the inner and outer walls 14 and 16.

With reference to FIG. 4, the relationship between the inner walls 14 and outer walls 16 of the housing 12 can be seen. If desired, as illustrated, a scuff panel 100 can be disposed inside the passenger receptacle 18 to line the same and to provide additional durability to the raft 10. The sections of the inner and outer walls 14 and 16 are joined together at the front edge of the housing 12 by a termal bond or weld 102. Similarly, other sections of the housing 12 are joined together as necessary, such construction being well within the skill of one of ordinary skill in the art.

The essential features of the present invention i.e., the cords 60 and 76, can be seen in enlarged detail in FIGS. 5 and 6. FIG. 5 shows a representative section of the chambers and subchambers formed between the inner and outer walls 14 and 16 and the cords 60 disposed therein. The cords 60 may be fixedly secured to the walls 14 and 16 by strips of material 104 which are wrapped partially around the cords 60 and which are fixedly secured to the housing 12. The strips of material 104 preclude the migration of the cords 60 from their desired locations within the chambers and subchambers thereof so that they may perform the function described above. Similarly, the cords 76 are secured in position.

Of course, other methods of securing the cords 60 and 76 in position may be employed. For instance, the cords might be directly bonded to the housing 12 or other suitable structure could be employed to keep the cords in position. When the housing 12 is inflated as illustrated in FIG. 5, it can be seen that the cords do not affect such a condition. With reference to FIG. 6, when the housing 12 is in a deflated position, the cords are tightly sandwiched between the inner and outer walls 14 and 16 thereof adding little bulk to the housing 12 as a consequence of performing their bleeding function. This permits the very compact folding of the housing 12.

Figure 7:
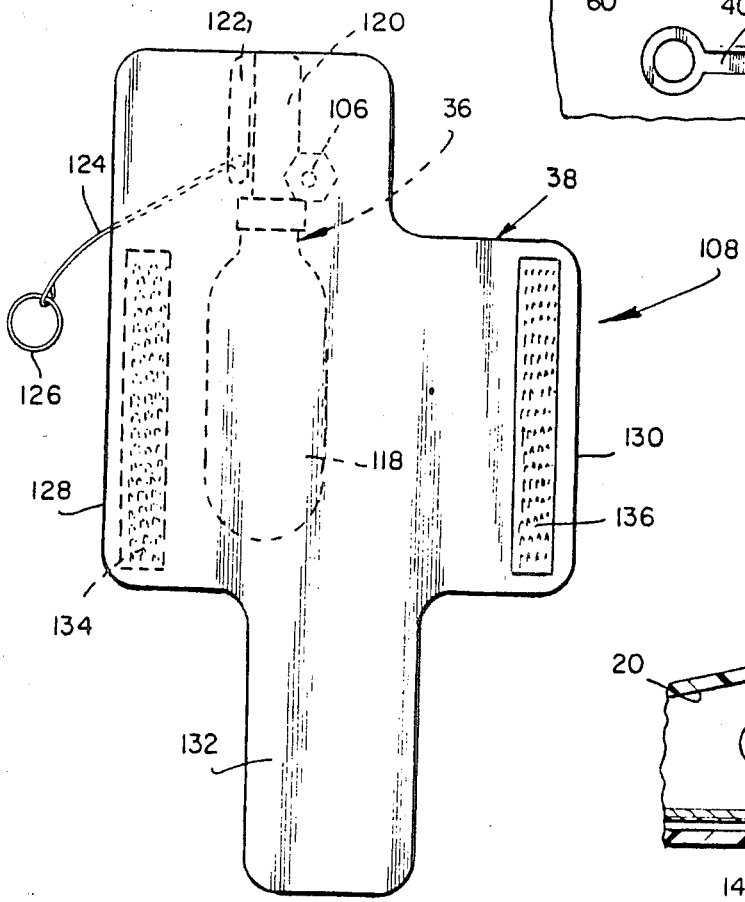
FIG. 7 is a side view of the gas inflation assembly of the present invention and the cover panel therefor.
Figure 8:
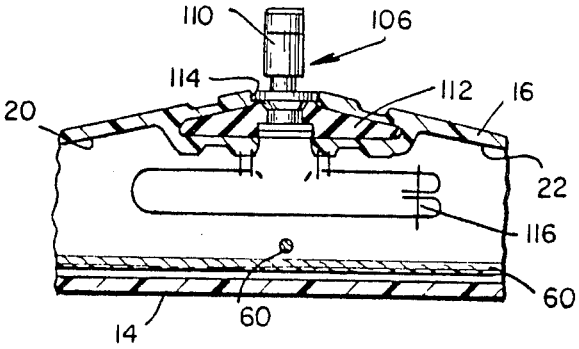
FIG. 8 is a cross sectional view of the manifold stem to which the gas inflation assembly of FIG. 7 is mounted.

Referring now to FIGS. 7 and 8, there is illustrated therein the compressed gas filing assembly 36, the manifold 106 onto which the assembly 36 is mounted, and a cover 108 which covers the assembly 36. The manifold 106 includes a conduit 110 fixedly secured to a mounting 112, the mounting 112 being fixedly secured to the outer walls 16 of the housing 12, the conduit 110 extending through an aperture 114 disposed therein. Mounted to the mounting 112 is a deflector 116 which deflects gas entering the conduit 110 and directs it into the $CO_2$ inflatable chambers 20 and 22. The mounting 112 may be constructed of rubber or the like and is termally bonded to the outer walls 16.

Of course, other suitable assemblies can be used in substitution for the manifold 106 so long as a passage is provided to the chambers 20 and 22 for a filing gas. The compressed gas filing assembly 36 includes a bottle of $CO_2$ 118 which is mounted on a valve 120. The valve 120 includes an activating assembly 122 having a cord 124 terminating in a ring 126. When the ring 126 is pulled, it moves the cord which in turn causes the activating assembly 122 to open the valve 120 and pierce the $CO_2$ bottle 118 permitting the gas disposed within the $CO_2$ bottle 118 to enter the manifold 106 through the conduit 110 thereof. This causes the $CO_2$ inflatable chambers 20 and 22 to be inflated. Although $CO_2$ has been discussed as the gas which is used for inflation, it is to be understood that other suitable compressed gases may be employed.

To protect the pressurized gas filing assembly 36, the cover 108 is provided. The cover 108 includes a pair of ears 128 and 130 which are dimensioned to be wrapped around the $CO_2$ bottle 118. Additionally, the cover 108 includes a tongue 132 dimensioned to be tucked under the $CO_2$ bottle 118. Velcro type fastenings 134 and 136 are provided to secure the ears 128 and 130 and are fixedly secured, respectively, to the ears 128 and 130, the fasteners 134 and 136 being of complimentary types. In order to protect the compressed gas filing assembly 36, the tongue 132 is tucked under the bottle 118 and the ears 128 and 130, in order are tucked under the $CO_2$ bottle 118 and around the tongue 132 such that the fasteners 134 and 136 can be engaged creating an effective protective package for the assembly 36. When use of the assembly 36 is desired, the cover 120 can be easily and quickly disengaged from about the assembly 36 yet it is well protected when not in use.

Figure 9:
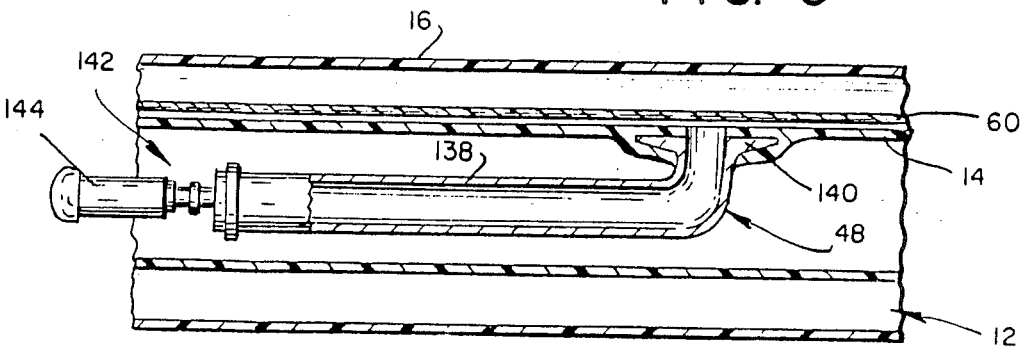
FIG. 9 is a fragmentary enlarged partially broken away and cross sectional view of an oral inflation valve of the present invention.

Illustrated in FIG. 9 is the oral inflation valve 48, the structure of which is also representative of the oral inflation valve 46. The oral inflation valve 48 includes a tube 138 terminating in a mounting flange 140 at one end thereof and a valve assembly 142 including a mouthpiece 144 at the other end thereof. The mounting flange 140 is fixedly secured to the wall 14 of the housing 12 such that the tube 138 is in communication with the chamber formed between the walls 14 and 16. The oral inflation valve 48 is of a well known type and operates such that when the mouthpiece 144 is pressed against the tube 138, the mouthpiece 144, by virtue of the opening of the valve 142, is put in communication with the interior of the tube 138 permitting the exhilation of the user to enter the chamber. When the mouthpiece 144 is released, the valve assembly 142, which is spring loaded, releases and seals off the interior of the tube 138 from the mouthpiece 144. As a result, once inflation is achieved, it can be maintained.

If desired, the contours and configurations of the life raft 10 can be modified in accordance with the desires of the manufacturer. For instance, the taper of the passenger receptacle 18 as well as the shape of the canopy 62 might be modified. Furthermore, the relationship between the inflatable chambers relative to oral or compressed gas inflation can be modified as desired within the skill of one of ordinary skill in the art. In addition, if necessary for particular reasons, certain sections of the chambers can be devoid of a bleeding cord.

It is also to be understood that the essential characteristic of the present invention is the employment of the bleeder cords disposed within the inflatable chambers and such a teaching is equally applicable to inflatable apparatuses having an entirely different character than the hereinbefore described life raft. For instance, inflatable tubes, water toys, platform rafts, or the like may also employ the basic teaching of a bleeder within the inflatable chambers thereof within the scope of the present invention.

Although the bleeder means of the present invention has been described as a cord, it should be apparent to one ordinary skill in the art that other suitable structure to accomplish the same function can be employed within the scope of the invention. For instance, a web or strip of material could be disposed within inflatable chambers and might possibly be bonded to the walls thereof to accomplish the bleeder function. As hereinbefore described, the materials employed to construct the disclosed life raft are merely for purposes of illustration and it is to be understood that the invention may also be practiced with different types of material joined together in a suitable manner.

Additionally, although the illustrative embodiments of the invention have been described in detail herein with reference to the accompanying drawings, it is to be understood that the invention is not limited to the precise embodiment, and that various changes and modifications may be effected herein without departing from the scope or spirit of the invention.

We claim:

1. An inflatable life raft comprising:

A. a flexible housing formed of inner and outer walls, said inner and outer walls forming therebetween a plurality of inflatable chambers; and B. flexible non-inflatable bleeder means detached from and disposed entirely within said plurality of chambers for keeping said chambers in communication with each other when deflated to provide a reduced storage volume.

2. An inflatable life raft as defined in claim 1, wherein said bleeder means comprises at least one cord disposed in each of said inflatable chambers.

3. An inflatable life raft as defined in claim 1, wherein a first plurality of chambers are isolated from a second plurality of chambers, said bleeder means comprising a plurality of cords, at least one of said cords being disposed in each of said first and second plurality of chambers.

4. An inflatable life raft as defined in claim 3, further comprising compressed gas storage means for inflating said first plurality of chambers and oral valve means for inflating said second plurality of chambers.

5. An inflatable life raft as defined in claim 2, wherein said cords are fixedly secured at selected locations by strips of material, said strips of material being wrapped around a portion of an associated cord and fixedly secured to selected portions within said plurality of chambers.

* * * * *